United States Patent [19]

Patsy

[11] Patent Number: 4,700,952

[45] Date of Patent: Oct. 20, 1987

[54] PROGRAMMABLE MOVING TARGET SOCCER PRACTICE

[76] Inventor: Samuel M. Patsy, P.O. Box 835, Rockville, Md. 20853

[21] Appl. No.: 910,475

[22] Filed: Nov. 14, 1986

Related U.S. Application Data

[60] Division of Ser. No. 682,985, Dec. 18, 1984, Pat. No. 4,645,210, which is a continuation-in-part of Ser. No. 467,679, May 17, 1983, abandoned, which is a continuation of Ser. No. 118,828, Feb. 5, 1980, abandoned.

[51] Int. Cl.[4] ..... F41J 9/02

[52] U.S. Cl. ..... 273/369; 273/406; 273/411

[58] Field of Search ..... 273/359, 369, 370, 403, 273/404, 406, 407, 410, 411; 211/119.01–119.1

[56] References Cited

U.S. PATENT DOCUMENTS

| | | |
|---|---|---|
| Re. 30,013 | 5/1979 | Knight . |
| 2,569,594 | 10/1951 | Aagesen . |
| 2,793,038 | 5/1957 | Wallace et al. . |
| 3,467,380 | 9/1969 | Bonacci . |
| 3,728,480 | 4/1973 | Baer . |
| 3,914,879 | 10/1975 | Taylor, III et al. . |
| 4,072,313 | 2/1978 | Murso et al. . |
| 4,076,247 | 2/1978 | Kim et al. . |
| 4,092,023 | 5/1978 | Hazen . |
| 4,103,892 | 8/1978 | Hinze . |
| 4,222,564 | 9/1980 | Allen et al. . |

OTHER PUBLICATIONS

1977 Product Guide, Micro Electronics General Instruments Corp., p. 4.

*Primary Examiner*—Leo P. Picard
*Attorney, Agent, or Firm*—Hall, Myers & Rose

[57] ABSTRACT

The apparatus provides a moving target for practicing perceptual and perceptual motor skills particularly for education, therapy, athletics and amusement. The moving target may be large or small at ground level and may be propelled at various different speeds in opposite directions. The interval of movement in a given direction is variable selectively or randomly as is the pause time between intervals of movement and speed. The movement of the target permits the practice for training and increasing motor skills, adaptability and attentiveness to time, distance, direction and force at all levels of skill.

8 Claims, 12 Drawing Figures

PROGRAMMABLE MOVING TARGET SOCCER PRACTICE

This is a divisional application of application Ser. No. 682,985, now U.S. Pat. No. 4,645,210, filed on Dec. 18, 1984, of Samuel M. Patsy, which is a continuation-in-part of Ser. No. 6,467,679, filed May 17, 1983, now abandoned, which is a continuation of Ser. No. 118,828, filed Feb. 5, 1980, now abandoned.

TECHNICAL FIELD

The present invention relates generally to training devices and specifically to devices for training and improving perceptual skills and perceptual motor skills.

More particularly the invention relates to moving target devices with automatic or manual direction and speed controls for training and improving perceptual skills and perceptual motor skills.

BACKGROUND OF THE INVENTION

Fundamental to the ideal development of a child or young adult is an ability to perceive and react to his or her surroundings. Parents and teachers monitor the development of a child by observing the child's ability to perceive changes in the environment and suitably respond or adapt to the changes. For example, one of the noted milestones in the early stages of infancy occurs when the infant develops the ability to follow a person or an object with the eyes.

It is not uncommon that a normally developed individual becomes involved in some catastrophic event which necessitates that these fundamental skills be relearned. Therapy, often prolonged and difficult, is necessary for the individual to resume his/her place in society. Examples of such persons include victims of automobile accidents and wounded veterans. In these situations rehabilitation is necessary. In some instances the individual will never return fully to their former capacities. This then, involves a reeducation of the individual such that with their limitations, they can be most effective in coping with their environment and lead a fruitful life. Other individuals, handicapped or possessing subnormal or underdeveloped perceptual motor skills represent a significant segment of our community. A need exists for training aids the will facilitate the learning process in these situations.

Although several unique disciplines merit consideration; childhood development, handicapped and rehabilitation therapy, sports, and recreation all have the same foundation in motor skills. The principles of teaching motor skills remains the same; the application of these principles can be quite diverse. Researchers state that to teach perceptual and perceptual motor skills the learner must start slowly, develop a skill level, then move on to the next level of proficiency. As an individual's proficiency increases, the training must include increasingly difficult teaching exercises. Once a high performance level is achieved, the individual requires constant practice to maintain this high skill level.

Thus a device for teaching motor skills must be versatile enough to teach the unskilled, stimulate the average individual, and challenge the professional. Specifically, the device must teach the kinesthetic and mechanical factors of motor skills for a particlar discipline to a broad spectrum of skill levels. The device must offer success to every user, regardless of skill level, yet challenge every user to advance to their next higher level of proficiency.

Simple exercises such as pointing and following a moving object, jumping when the object moves and standing still when it stops, or performing certain directed activities linked to the behavior of an object, assist in the development of motor skills, adaptability and attentiveness.

Depth perception, peripheral vision and hearing capacities may also be improved through various exercises with a moving object having specific attachments. All of these skills are necessary for proper development and leading an active normal life.

Motor skills are divided into three factors; kinesthetic, mechanical and motivational. The kinesthetic factor involves the cognitive awareness of the temporal-spatial relationship of time, force and space, more commonly known as the "feel" or "touch" of an object. Time relates to a continuum from slow to fast. Force relates to a continuum from slight to heavy; referred to as degree or intensity. Space has two continuums, level and range. Level is either high or low; range is either short or long.

The mechanical factors involve speed, accuracy, form and adaptability. Researchers explain that there is significant difference in brain activity while performing the same activity but at different speeds. The speed of the activity determines which "neural programs" will be called into action. Accuracy is a classic measure of success. Again, it is known that a considerable difference exists in the muscle tone required for an accurate kick or pass as opposed to a powerful kick or pass. Form relates to economy of effort and has two implications: one is a more relaxed, smoother performance and is referred to as "finesse." In the other the individual devotes less time to the action itself, allowing him to become more observant of environmental queues and is able to respond to those queues. Adaptability relates to this capacity to perform an activity in a changing environment.

In order to teach skills, a third set of factors are necessary; namely, motivational factors. The motivational factors consist of attentiveness, incentive for improvement, measurement of improvement and feedback or knowledge of results.

Attentiveness requires an individual to devote his undivided attention to the training activity. As to incentive, there must be some challenge to the individual to advance to the next level of proficiency. Measurement of performance requires that there be some method of determining improvement in performance. Feedback in the context of the present invention relates to imparting to the individual knowledge of the results. This knowledge is considered by researchers in motor skills to be the single most important factor in learning.

As stated, the factors of perceptual and perceptual motor skills span a broad spectrum of disciplines.(These include such fundamentals as walking and stopping to fine motor control such as propelling an object through a fast moving target). These include child development, therapy, rehabilitation, research, special education, athletics and amusement.

The following exemplifies various applications of perceptual motor and motor skills in various disciplines.

In early childhood pattern recognition, time-space relationship, three dimensional motion, depth perception, hand-eye control, walking motion patterns, stop/-start motion, and attentiveness training are developed.

Therapy and rehabilitation often include visual training, pacing studies, directional changes, non-locomotor patterns, locomotor patterns, visual tracking, word recognition and impulse control measured motor response for walking and limb movement, coordination exercises, visual training, attention span exercises, queued exercises and treating depth perception problems.

The complexities in motor skills in athletics range from situations where the player is stationary and the ball is stationary, such as golf, to situations where the player moves while the ball or puck is moving as in soccer or hockey. The concepts of movement; performing in a changing environment; the dynamics of motion, with or without a ball are an integral part of most sports. Thus athletics involve; motion patterns for any age group, as well as any skill level, a moving target for any age group or skill level, directional changes, stop/-start patterns and attentiveness training.

SUMMARY OF THE INVENTION

It is therefore an object of the present invention to provide a device directed to developing perceptual and perceptual motor skills.

It is another object of this invention to adapt to various skill levels to increase perceptual and perceptual motor skills.

Still another object of this invention is to develop kinethetic and mechanical abilities associated with motor skills.

Yet another object of this invention is to provide a device for use in a broad range of disciplines including but not limited to education, therapy, rehabilitation, athletics and amusement.

It is another object of this invention to provide a device which is adaptable for use in a variety of environments.

It is yet another object of the present invention to provide a moving target, whose movement patterns can be manually controlled, programmed, or random It is another object of this invention to provide a target which may be moved along a predetermined path of variable length.

It is another object of the present invention to provide a dynamic teaching device allowing an individual to practice various skills by himself.

It is another object of this invention to be versatile enough to treat each user as unique.

It is another object of this invention to provide a device capable of quantative measurement of performance.

It still is another object of this invention to provide for a quantative measure of the improvement in performance.

It is yet another object of the present invention to provide a moving target, whose movement patterns can be programmed, random or manually controlled.

It is another object of the present invention to provide a dynamic teaching device allowing an individual to practice various skills by himself.

It is still another object of this invention to provide a device for teaching of individuals of greatly different perceptual and perceptual motor skills from the handicapped to the professional athlete.

It is another object of this invention to be versatile enough to treat each user as unique.

Still another object of this invention is to be a teaching device for any sport that requires surface passing, such as soccer, ice hockey and field hockey.

The illustrated embodiment, a fixed location, below ground model is so constructed and arranged that water and dirt are diverted away from all the parts of such structure, whether moving or stationary. In this embodiment of the invention, the moving target is supported on rods extending below abutting surfaces of flexible gaskets, having disposed therebelow a generally curved member, which deflects water, dirt, etc. into unoccupied areas on either side of the target support path and drive. The target is moved by an electric motor.

The use of this invention can be tailored to suit the needs of an individual or group. Also particularly in the context of competitive sports, multiple devices may be arranged and operated in various manners to simulate specific situations.

The illustrated embodiment and others will become obvious to those of ordinary skill in the art from the following detailed description.

BRIEF DESCRIPTION OF THE DRAWINGS

The above and still further objects, features and advantages of the present invention will become apparent upon consideration of the following detailed description of one specific embodiment thereof, especially when taken in conjunction with the accompanying drawings wherein.

DETAILED DESCRIPTION OF THE DRAWINGS

Figure 1:
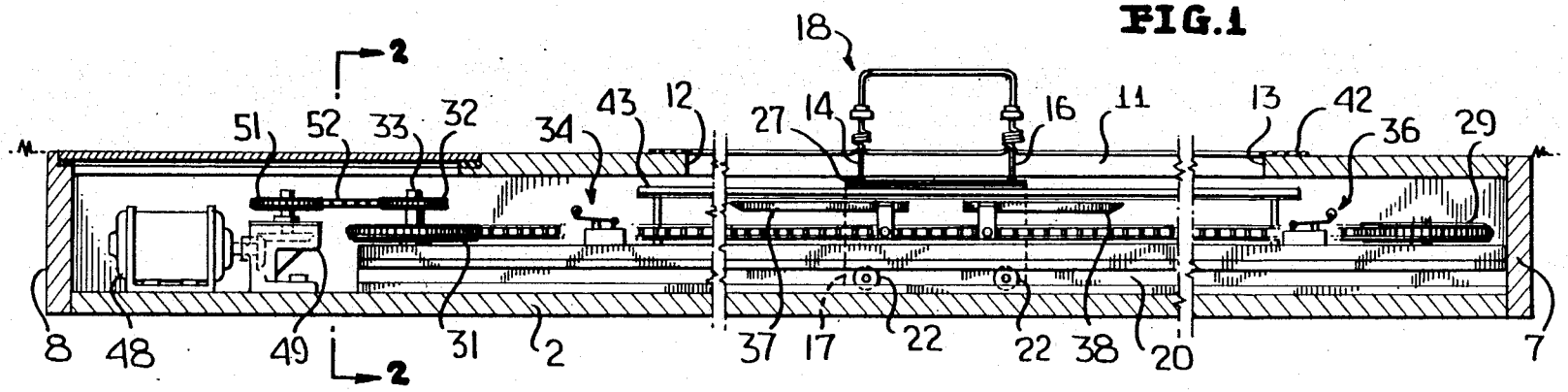
FIG. 1 is a detailed top view of the slide and limit switch arrangement.
Figure 2:
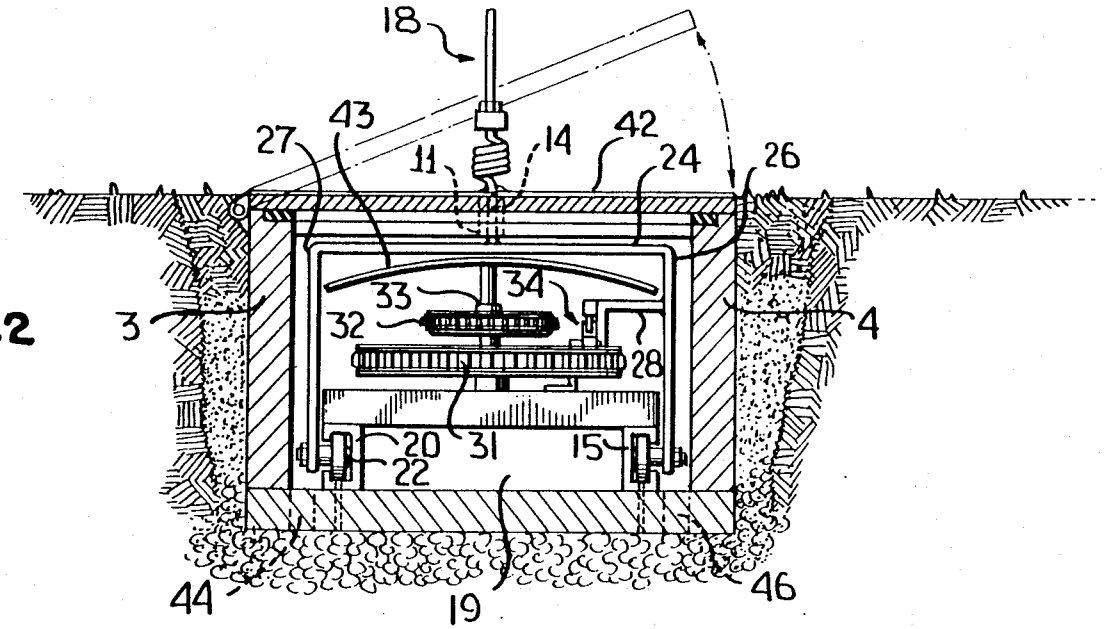
FIG. 2 is an end view taken along section lines 2—2 of FIG. 1.
Figure 3:
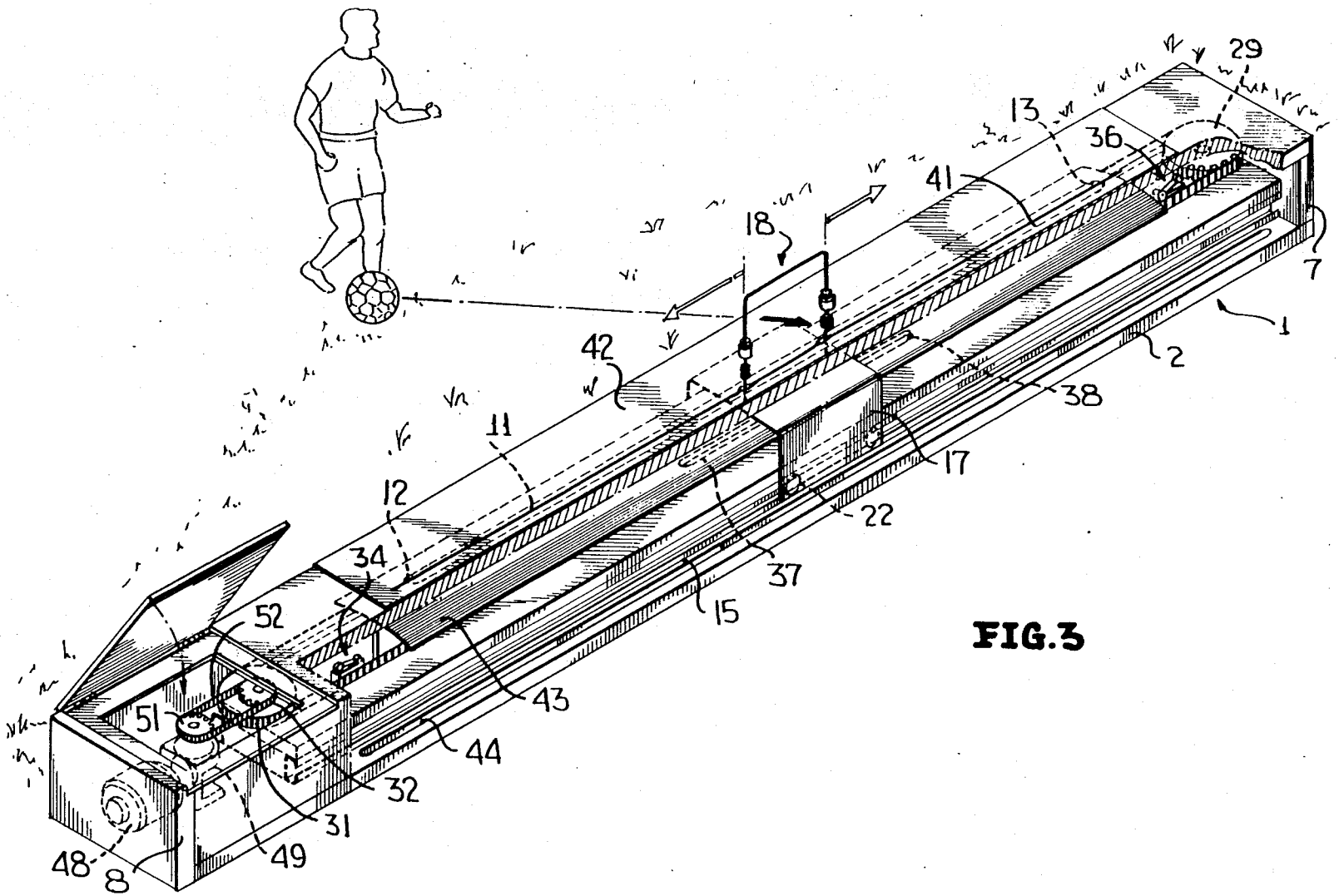
FIG. 3 is a perspective view of the ground implacement arrangement of the apparatus of the present invention.

Referring now specifically to FIGS. 1 through 3, the basic apparatus of the present invention constitutes an elongated generally rectangular box 1, having a bottom wall 2, spaced parallel side walls 3 and 4 and a cover 6. The box 1 normally will be formed as concrete pourings or aluminum since the box can be quite long, running 50 to 100 to even 150 feet or longer. The box 1 also includes end walls 7 and 8 with the end wall 8 having a slot 9 formed therein for purposes to be described subsequently. Also, the top wall 6 has an elongated narrow slot 11 extending between locations 12 and 13. Support members 14 and 16 of a target to be described subsequently extend upwardly from a slide 17 located in the box 1 through the slot 11 to support the target generally designated by the reference numberal 18.

The slide 17 is suitably supported for movement along a stationary support member 19 extending generally the entire length of the box 1. The longitudinally extending sides 15 and 20 of the support 19 are recessed to provide tracks 21 and 22 in sides 15 and 20 to accept rollers 23 rotationally supported on the slide 17. Specifically, slide 17 carries four such rollers 22, two along each side of the slide with the two rollers on each side positioned in its associate track 21 and 22, respectively. In consequence, the slide may move easily along the length of the support 19 with a high degree of stability provided by the four-point sliding or rolling support.

It should be noted that the use of rollers, although perhaps preferable, is not essential since other forms of low friction slide arrangements are available.

Slide 17 is generally an inverted U-shaped member having a top member 24 and side members 26 and 27 to which the rollers 23 are secured. The top member 24 of the U-shaped slide 17 is located just under the cover so that a minimum length of supports 14 and 16 must be provided to position the target 18 above the ground.

The slide 17 is driven by an endless belt 27, the slide being secured to the belt by means of a member 28 connected between the belt 27 and wall 26 of the slide. The endless belt 27 is disposed about two pulleys 29 and 31 located at the right and left ends, as viewed in FIG. 1, of the box 1. The pulley 31 is driven from a further pulley 32 coaxial with the pulley 31 and supported on a common shaft 33.

Limit switches 34 and 36 are provided to sense the position of actuators 37 and 38, respectively, extending outwardly from the left and right edges of the slide 17, respectively. The actuators 37 and 38, as the slide approaches the left to right ends, respectively, of the box engage arms of the limit switches 34 and 36. The switches either terminate energization of a driving motor to be described subsequently, or constitute reversing switches which cause the slide to terminate travel in one direction and assume travel in the opposite direction.

Continuing with the description of the mechanical structure, the box 1 is sunk into the ground and is provided on its upper surface with resilient members 41 and 42 which are parallel to and secured to the top of box 6 and extend into resilient contact with supports 14 and 16 of the target 18. The purpose of this arrangement is to minimize the entry of water into the mechanism. A generally curved plate 43 extends from one end of the box to the other, being secured to end walls 7 and 8, is disposed over the belt 27 adjacent the top 24 of the slide 17. Member 43 is a curved convex upward and serves to deflect any water or foreign material that may enter through the slot 11 in the top 6 of the box away from the belt 27. The switches 34 and 36, pulleys 29, 31, 32, etc., are disposed beyond the end of the slot 11 and are fully protected by the top of the box 1. Since the slide extends outwardly of the base 19, the curved member 43 extends about to the edge of the base 19 adjacent the members 26 and 27 of the slide. Any water or dirt or related material that enters the box and down from the edge of the member 43 does fall toward the tracks 21 and 22; however, the quantity of material falling is at all times small and since the wheels are located above the base member 2 and are recessed into the side of the member 19, little trouble is encountered as a result of the entry of foreign material into the device.

The box is embedded basically in a gravel environment within the earth and is provided with drain holes such as 44 and 46 so that there is no accumulation of water in the system. The box is situated in the ground such that the upper surface of the flap 41 and 42 are basically level with the surrounding earth and preferably ground is slightly tapered away from the edges of the box so that there is no water running from the surrounding environment into the box and the only water that enters is virtually only that which falls directly on the intersection of flaps 41 and 43.

Secured to the left end of the box as viewed in FIG. 3 is a further enclosure 47 in which is located motor 48 which drives, through a gear box 49, a pulley 51 for driving a belt 52 engaging the pulley 32 in the main box 1. The belt 52 extends through the slot 9 in the end wall of the box 1 as previously described. The enclosure 47 has a top member or cover 6 suitably hinged to the top of the box 47 and gasketed so as to be watertight. The cover 6 may be hinged so that it may be opened to provide access to the motor. The motor 48 may be reversible or it may be provided with a reversing gear in the gear box 49 as desired.

Figure 4:
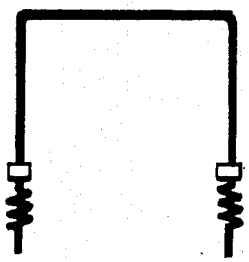
FIGS. 4–9 are side views of various targets that may be employed with the apparatus.
Figure 5:
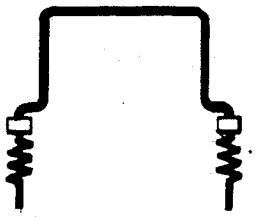
Figure 6:
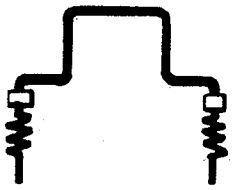
Figure 7:
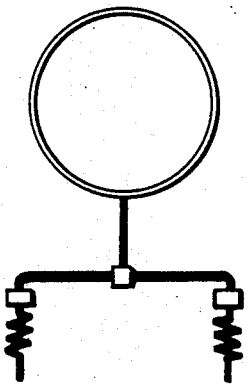
Figure 8:
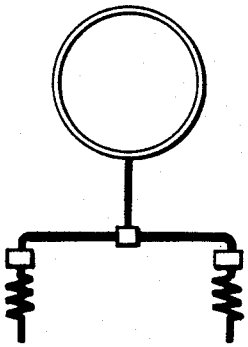
Figure 9:
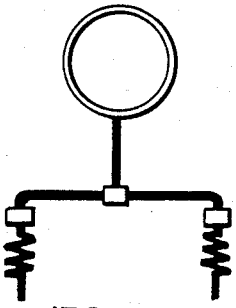

Referring now to FIGS. 4 through 9, there are illustrated various types of targets which may be carried on the support guides or members 14 and 16. It will be noted that each target is terminated at its lower end and as viewed is in the FIGS. 4 through 9 with springs which are secured to the posts members 14 and 16 thereby insuring the posts 14 and 16 are isolated from inpact of the ball on the target. FIGS. 4 through 6 illustrate simple pass-through targets of different sizes which are used for training individuals of different skill levels. The largest target, FIG. 4, is relatively large compared with the soccer ball perhaps providing four inches around the two sides and the top between the maximum size of the ball and the size of the target. Target 5 is somewhat reduced in the size and target 6 is barely as large as the ball and requires extreme accuracy in passing to cause the ball to pass through. One leg of a target may be disconnected from a support 14 or 16 to permit the target to be rotated. FIGS. 7, 8 and 9 represent hoop targets which may be carried at different heights above the ground and are used to practice chipping, head balls and volley passes. Again, the largest target 7 is for the unskilled player, the target 8 or FIG. 8 is for average skilled, and target 9 is for highly skilled college-level or professional players. Rotation of targets of FIGS. 7–9 is easily effected and provides different approach direction for practice.

The illustrated embodiment is adapted for permanent installation, the use of which may be subject to inclement conditions.

The hand held control console, operable in a manual or programmable mode to select run time, stop time and target direction is now described.

A typical scenario might be as follows:

The coach selects the following parameters:

Speed Medium—6 Feet/Sec. (approximately)

Run Time—4 Seconds.

Stop Delay—8 Seconds.

In the device of FIGS. 1–9, the target runs for four seconds feet/second. The target covers twenty-four feet in the direction it was going—unless the target hits the reversing switches 33 or 36, in which case it reverses and completes its four-second run. At the end of the four seconds, the target stops for eight seconds. At this point in time, the coach may do any one or more of the following:

Toggle the reverse switch:

Speed Fast—10 Feet/Sec. (approximately)

Run Time—2 Seconds.

Stop Delay—4 Seconds.

Rotate the target 15 degrees to the left (done manually thus beginning an entirely new passing drill.

As mentioned, one object of the device as a teaching tool is to teach accuracy. This is accuracy relates to both delivery of the ball to a teammate and to avoid a defender. The coach can use the device to simulate virtually every aspect the movement of both a team member and/or an opposing player. After the coach has progammed the control console, he is free to observe or to go work with another group.

Alternatively, an individual player may wish to come to the field and program the console controller and begin his training session, practicing alone.

The control console provides the variable parameters from which the coach may choose. Thus, the utility of the device is limited only by the coach's imagination.

Figure 10:
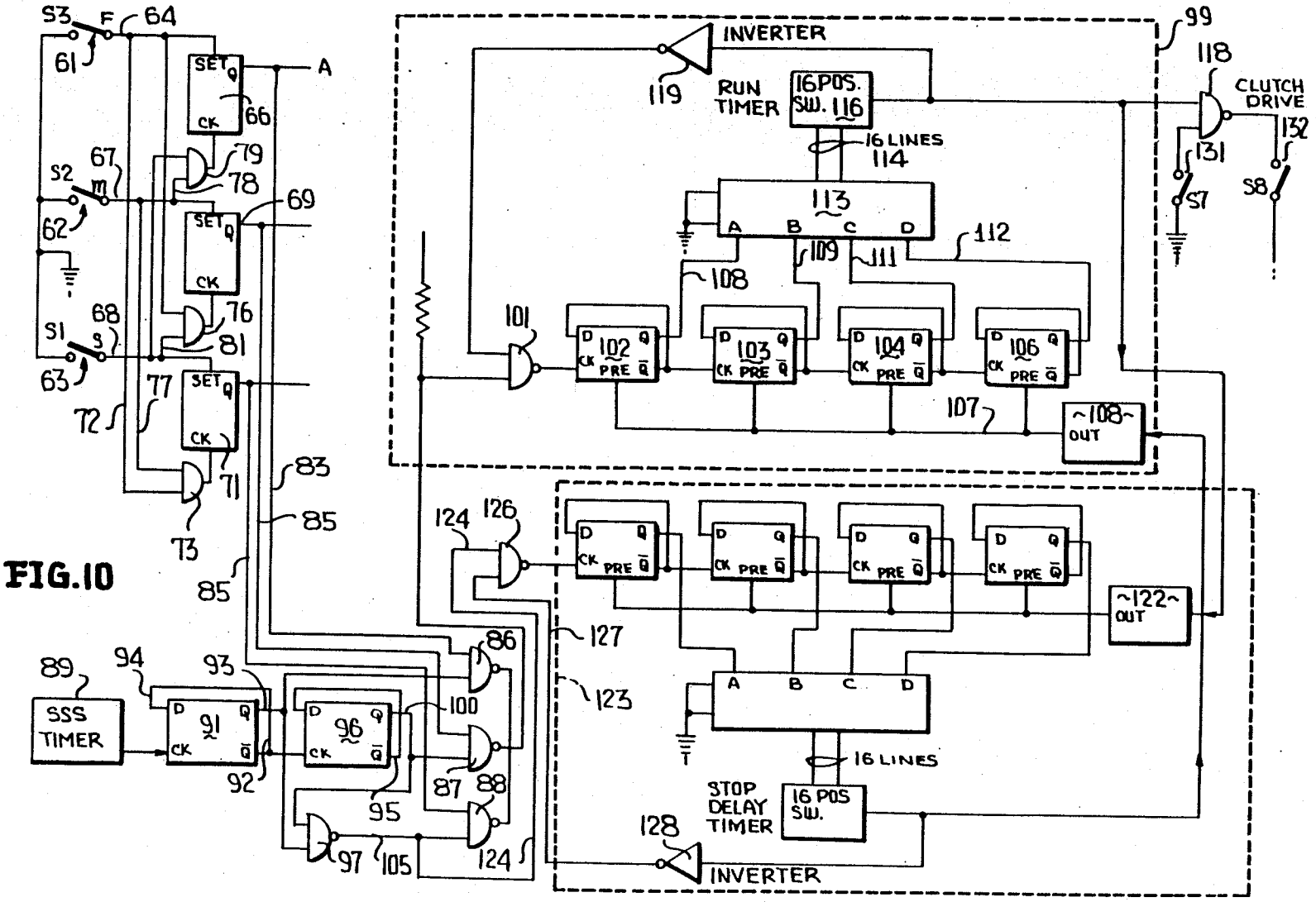
FIG. 10 is a circuit diagram of a run-stop motor control for the circuit.

In order to accomplish these other modes of operation, a control circuit which may be preprogrammed must be provided and one such relatively simple electrical diagram for such controls is illustrated in FIG. 10 of the accompanying drawing.

Referring now specifically to FIG. 10 of the accompanying drawing, the control apparatus is provided with three speed switches, 61 for fast, 62 for medium, and 63 for slow. The left contact as viewed in FIG. 12 of each of the switches 61, 62, 63 is grounded; the movable or right contact the switch 61 being connected via lead 64 to set contact terminal of flip-flop 66. The right contacts of the switches 62 and 63 are connected via leads 67 and 68, respectively, to set the terminals of flip-flops 69 and 71, respectively. Lead 64 is connected via lead 72 to one input terminal of AND gate 76. Lead 67 is connected via a lead 77 to a second input terminal of AND gate 73 and via a lead 78 to an input terminal of AND gate 79. Lead 68 is connected via lead 81 to a second input terminal of AND gate 76. Lead 68 is also connected via lead 82 to a second input to AND gate 79; and gates 73, 76 and 79 have output leads connected to reset terminals of flip-flops 71, 69 and 66, respectively.

In operation, upon closure, for instance, of the slow switch 63, lead 68 is grounded and flip-flop 71 is set to increase the output voltage on its terminal designated C and currently the grounding signal is provided to AND gates 76 and 79 which reduce their outputs to reset flip-flops 69 and 66 so as to lower the voltages on their B and A terminals, respectively. The A-B-C terminals of the flip-flops are connected via leads 83, 84 and 85 to one input each of AND gates 86, 87 and 88, respectively.

A clock 89 provides a clock signal to the CK input of a flip-flop 91 connected as a divide-by-two device having output leads 92 and 93. The output lead 92 (Q) is connected back to second input of the flip-flop 91 whereby to provide the divide-by-two function. The output lead 91 is also connected to CK input of flip-flop 96, another divide-by-two circuit. Lead 93 (Q) of flip-flop 91 is connected to an input of AND gate 86. An output lead 95 (Q) of flip-flop 96 is connected to its D input to provide the divide-by-two function and its Q output on lead 100 is connected as one input to AND gate 87. Leads 93 and 100 are connected to input of a AND gate 97 whereby divide-by-two, four, and six are available on leads 92, 95 and 105, respectively. Thus, switches 61, 62 and 63 select an appropriate gate 86, 87, 88 to determine the pulse rate on a lead 98 which is connected in parallel to the output circuits of all three of the gates 86, 87 and 88.

It should be noted that the flip-flops 66, 69 and 71 are selectively reset by the AND gates 73, 76 and 79. When switch 63 is closed, for instance, leads 64 and 67 are high and the reset inputs CD of these gates are high producing a low output at Q.

The pulses on the lead 98 are applied to a run timer circuit enclosed within dashed-line box generally designated by the referenced numeral 99. The lead 98 is connected to one input of a AND gate 101, the output of which is connected to flip-flop 102 of a series of flip-flops including flip-flops 103, 104 and 106, each connected as a divide-by-two circuit. A preset input of each of these circuits is connected to a common fuse 107 receiving an output signal at an appropriate time from a one-shot multivibrator.

The Q outputs of circuits 102, 103, 104 and 106 are connected via leads 108, 109, 111, and 112, respectively, to inputs of a hexadecimal to decimal converter 113. The converter 113 is provided with 16 output leads 114, any one of which may be selected by a switch 116 to determine the time interval during which the motor is energized. Specifically, converter 113 provides a low output from the selected lead 114 until the timer times out, i.e., high voltage appears over the selected lead 114. At this time, the lead 117 goes high and negative AND gate 118 is blocked (switch 131 being open) removing energization from a drive clutch 138 (see FIG. 11) from the motor to the belt 52, specifically a clutch in the gear box 49.

When the lead 117 goes high, inverter 119 opens gate 101 and the pulse train to the run time 99 is discontinued. The high signal on lead 117 is transmitted via lead 121 to one-shot vibrator 122 which resets the timing circuit of a stop delay timer enclosed within dashed lines 123.

Input pulses to delay timer 123 are from the output lead of gate 97 thereby by-passing the selectively actuated gate 88. Such output (every sixth pulse of the clock 89) is conducted via lead 24 to gate 126 whereby delay timer 123 receives pulses whenever lead 124 and lead 127 from inverter 128 are high.

The delay timer has the same internal circuitry as the run timer and the output on its output lead 129 is low during operation of the delay timer. When the circuit times out, the voltage on lead 129 goes high removing the gating pulse from the lead 127 and applying a reset to the one-shot 108 which resets the run timer and lowers the voltage on lead 117 so that the gate 101 will again pass negative pulses on lead 98.

The run timer-delay timer provides a stop and go type of operation, running for an interval and stopping for an interval. If switch 131 is closed, a second input to gate 108 is grounded and lead 120 to the clutch solenoid remains high and the motor runs without interruption. A switch 132 may be inserted in lead 120 to stop the motor without turning off the device. This switch may be used when changing setting of the timers or changing targets, etc.

A forward-reverse arrangement is provided by a one-shot vibrator 134 and a divide-by-two circuit 136. A switch 137, when closed, grounds the input lead to the one-shot 134 and causes it to pulse. The pulse is applied to the clock (CK) input of the circuit 136 and matches the output control voltage between the Q and Q outputs. A second closing of the switch 137 reverses the signal on the outputs of 136 and reverses the direction of running of the motor.

Figure 11:
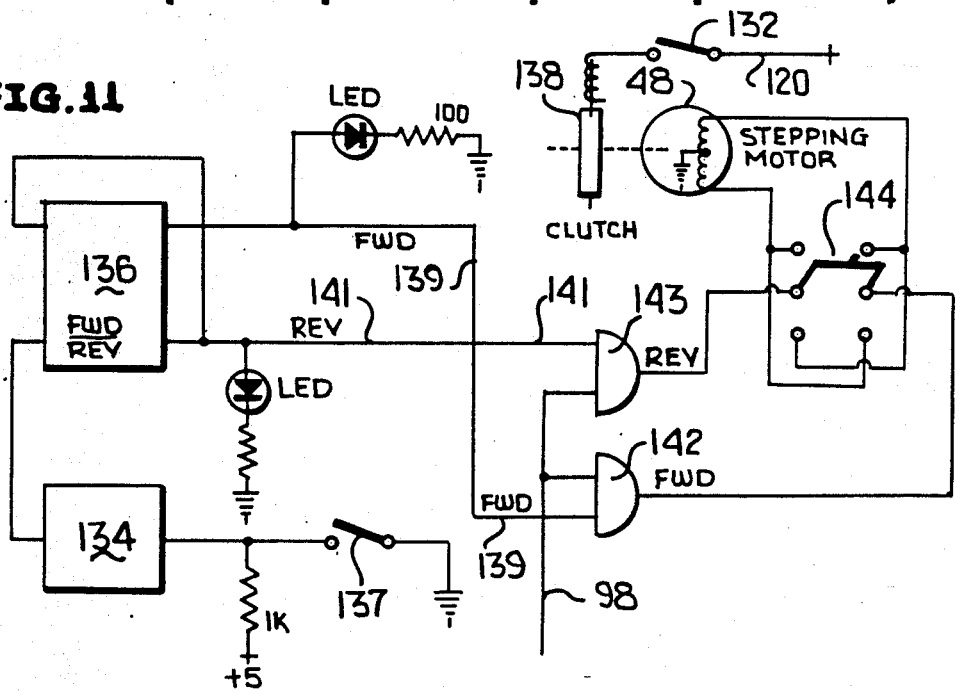
FIG. 11 is a circuit diagram of the motor and forward reverse control therefor.

The motor drive circuit is illustrated in FIG. 11. This circuit includes an input from lead 98 of FIG. 10 applied to AND gates 139 and 141 which also receive input on leads 142 and 143 from the forward and reverse of flip-flops 136. A reversing switch 144 represents the reversing switches 34 and 36 of FIG. 1.

The pulses on lead 98 are gated via one of gates 141 or 142 and switch 144 to stopping motor 48 to produce rotation of the drive pulley 51 of FIG. 3. As previously indicated, the system may be put into a neutral or idle state by deactuating clutch 138.

Figure 12:
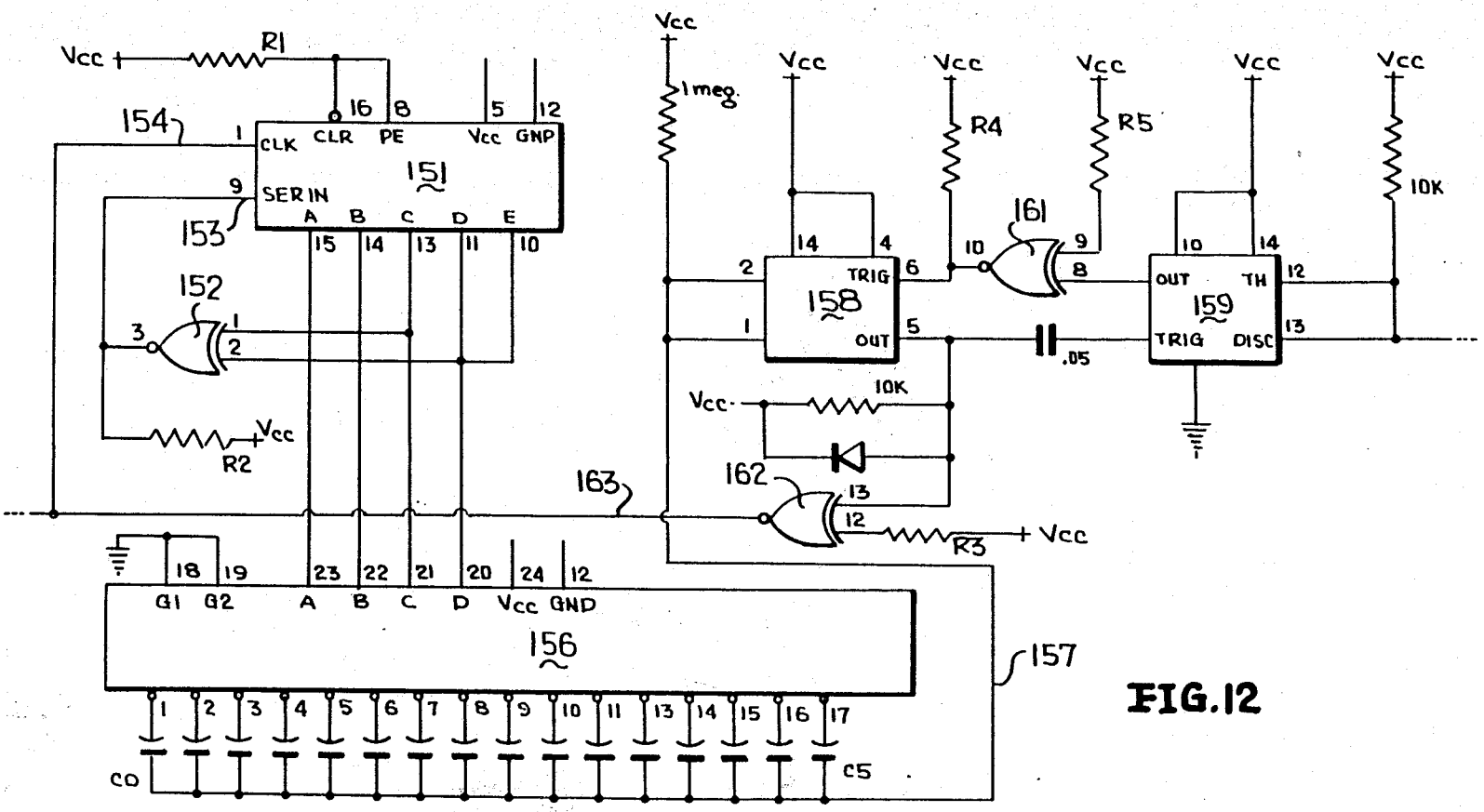
FIG. 12 is a circuit diagram of a random time generator for varying the speed of the motor on a random basis.

In some instances, it may be desirable to replace the constant speed of the motor with a random speed capability. Referring specifically to FIG. 12, a 7496 shift register 51 has its C, D and E outputs connected via exclusive or gate 152 to its serial input terminal 153. This connection is known to produce a relatively random output on output leads A–E. The register 151 is clocked via lead 154 which derives its pulses in a manner to be described.

The output terminals A–E of the register 151 are connected to the A through D input terminals of a 74154 shift register connected as a parallel input multiplier 156 having 17 output leads. Note that the output terminals D and E of register 151 are connected together.

Each combination of the four input signals to device 156 selects a different output lead 1–17 to change a different value capacitor $C_0$ to $C_{15}$. The aggregate voltage across the capacitors $C_0$ to $C_{15}$ appears on a lead 157 which quite obviously is in a state of continuous and unpredictable variation.

The randomness of the operation of the circuit is further enhanced by the use of voltage controlled oscillators (IC 556) 158 and 159 connected in a ring fashion. The VCO 158 is controlled by the varying voltage on lead 157. The output of VCO 158 is applied to the trigger input of VCO 159, the output of which is connected via exclusive OR gate 161 to the trigger input of VCO 158. The output of VCO 158 is connected via exclusive OR gate 162 to a lead 163 which serves as the output of the circuit and the input to register 151.

The ring arrangement of VCO's introduces additional randomness into the circuit as a result of the random voltage on lead 157 and the random trigger from gate 161.

The lead 163 may be applied to the circuit of FIG. 11 along with lead 98 through an exclusive OR gate to control the motor 48.

Another important feature of this invention is that it is capable, as indicated above, of providing a quantative measure of performance.

Once given the above disclosure, many other features, modifications, and improvements will become apparent to the skilled artisan. Such other modifications, features and improvements are, therefore considered a part of this invention, the scope of which is to be determined by the following claims:

I claim:

1. An apparatus for practicing motor skills comprising:

a target, means for supporting the target for movement along a predetermined path, means for selectively moving said target at various speeds and in opposite directions along said predetermined path, a trench, said means for supporting being disposed in said trench, means for protecting including a cover over said means for supporting, said cover having an elongated slot therein of approximately the same length of trench as said target, a plate extending at least the length of said slot below said cover, said plate being transversely inclined to direct water and dirt to a side of said trench.

2. An apparatus according to claim 1, wherein said means for supporting includes:

a member extending from below said cover, around at least one elongated edge thereof and through said slot to a position above said cover.

3. The device according to claim 2 further comprising:

gasket means disposed along the edges of said slot to resiliently engage said member where it extends through such slot.

4. The device according to claim 1 wherein said means for selectively moving further comprises:

means for varying the speed at which said target moves along said path, said means for varying including means for preprogramming speed variations and for randomly varying speed of said target.

5. The device according to claims 1 or 4 wherein said means for selectively moving comprises:

means for programming said target to intermittently run and stop moving along said path.

6. The device according to claim 5 wherein said run and stop intervals are independently selectable.

7. The device according to claims 1 or 4 further comprising means for changing the rotational position of said target about a vertical axis through said target.

8. The device according to claims 1 or 4 wherein said means for supporting said target is disposed below said cover and means for protecting said supporting means from water.

* * * * *